US009969546B2

(12) United States Patent
Kruger

(10) Patent No.: US 9,969,546 B2
(45) Date of Patent: May 15, 2018

(54) SINGLE SERVE CAPSULE COMPRISING A FILTER ELEMENT CONNECTED THERETO BY SEALING

(71) Applicant: K-FEE SYSTEM GMBH, Bergisch Gladbach (DE)

(72) Inventor: Marc Kruger, Bergisch Gladbach (DE)

(73) Assignee: K-Fee System GmbH, Bergisch Gladbach (DE)

( * ) Notice: Subject to any disclaimer, the term of this patent is extended or adjusted under 35 U.S.C. 154(b) by 0 days. days.

(21) Appl. No.: 14/431,959

(22) PCT Filed: Sep. 27, 2013

(86) PCT No.: PCT/EP2013/070251

§ 371 (c)(1),
(2) Date: Mar. 27, 2015

(87) PCT Pub. No.: WO2014/049143

PCT Pub. Date: Apr. 3, 2014

(65) Prior Publication Data

US 2015/0274411 A1 Oct. 1, 2015

(30) Foreign Application Priority Data

Sep. 27, 2012 (DE) ..... 10 2012 109 186

(51) Int. Cl.
*B65D 85/804* (2006.01)

(52) U.S. Cl.
CPC ..... *B65D 85/8043* (2013.01)

(58) Field of Classification Search
None
See application file for complete search history.

(56) References Cited

U.S. PATENT DOCUMENTS

| | | | |
|---|---|---|---|
| 3,795,182 | A | 3/1974 | Van Damme |
| 4,995,310 | A | 2/1991 | Van Der Lijn et al. |
| 2003/0172813 | A1 | 9/2003 | Schifferle |
| 2009/0007793 | A1 | 1/2009 | Glucksmann et al. |
| 2010/0297299 | A1 | 11/2010 | Epars et al. |
| 2011/0064852 | A1 | 3/2011 | Mann |
| 2011/0097450 | A1 | 4/2011 | Kruger |

(Continued)

FOREIGN PATENT DOCUMENTS

| | | |
|---|---|---|
| DE | 8533170 U1 | 1/1986 |
| EP | 1344722 A1 | 9/2003 |
| EP | 1 997 748 A1 | 6/2007 |

(Continued)

OTHER PUBLICATIONS

Definition of "Toroidal", Merriam-Webster. Captured Dec. 22, 2011. <https://web.archive.org/web/20111222150917/http://www.merriam-webster.com/dictionary/toroidal>.*

(Continued)

*Primary Examiner* — Viren Thakur
*Assistant Examiner* — Thanh H Nguyen
(74) *Attorney, Agent, or Firm* — McNees Wallace & Nurick LLC

(57) ABSTRACT

The present invention relates to a single serve capsule for preparing a beverage, comprising a side wall and a bottom, which together define a space, a filter element being sealed to the bottom within said space.

10 Claims, 3 Drawing Sheets

(56) References Cited

U.S. PATENT DOCUMENTS

Figure 1:
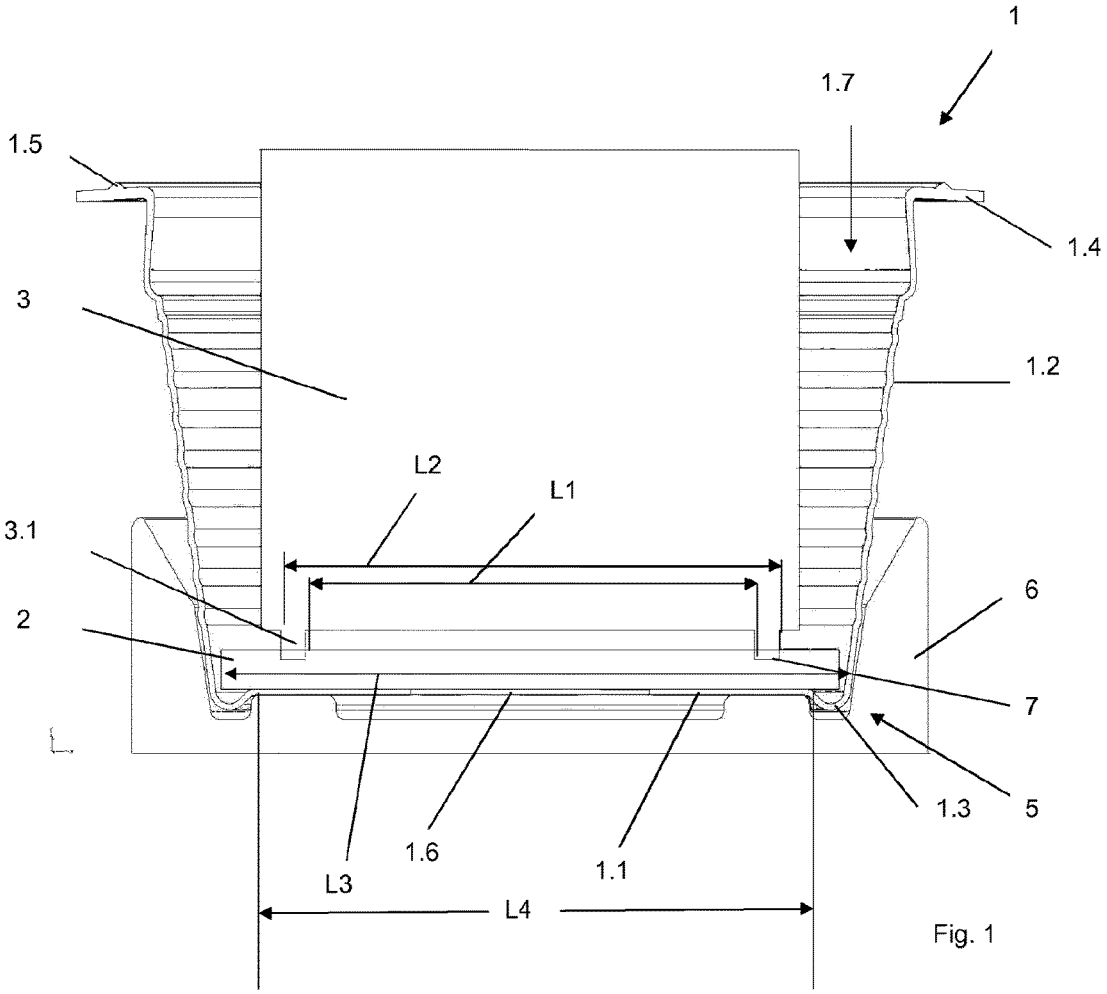

| | | | | |
|---|---|---|---|---|
| 2012/0070543 | A1 | 3/2012 | Mahlich | |
| 2012/0070551 | A1* | 3/2012 | Mahlich | B65D 85/8043 426/433 |

FOREIGN PATENT DOCUMENTS

| | | | |
|---|---|---|---|
| EP | 1792850 | A1 | 6/2007 |
| EP | 2412645 | A1 | 2/2012 |
| JP | S61124232 | A | 8/1986 |
| JP | S62168512 | A | 7/1987 |

OTHER PUBLICATIONS

Formal Translation of JP S61-124232, USPTO, Aug. 2017.*
English Translation of International Preliminary Report on Patentability, provided Jun. 2, 2015, 4 pages.

* cited by examiner

SINGLE SERVE CAPSULE COMPRISING A FILTER ELEMENT CONNECTED THERETO BY SEALING

The present invention relates to a single serve capsule for producing a beverage, having a side wall and a base which collectively define a space, wherein within the space a filter element is sealed to the base.

Single serve capsules of this type are known from the prior art and employed, for example, for producing coffee or tea or coffee-type beverages, such as espresso. For example, single serve capsules for preparing coffee and espresso are disclosed in the documents EP 1 792 850 B1, EP 1 344 722 A1, and US 2003/0172813 A1.

The single serve capsules are preferably in the shape of a truncated cone or cylindrical, and are produced from a vacuum-formed plastic film or by way of injection molding, for example. They typically have a side wall with an encircling flange, an open filling side for a beverage substrate which for producing the beverage is to be extracted and/or dissolved, and a capsule base, wherein a filter element which is supported on the capsule base is disposed between the beverage substrate and the capsule base. After insertion and sealing of the filter element to the single serve capsule base and filling of the beverage substrate, the single serve capsule is closed using a lid film which, for example, is sealed onto the flange or adhesively bonded thereto.

For preparing a coffee beverage, the single serve capsule is introduced into a brewing chamber of a preparation apparatus. Prior to, after, or during the introduction of the single serve capsule into the brewing chamber, the single serve capsule is opened, preferably on its base side, and upon sealing the brewing chamber, the filling side of the single serve capsule, which is closed using a closure film, is pierced by means of piercing means. Subsequently the preparation fluid, preferably hot water, is conveyed under pressure into the single serve capsule. The preparation fluid streams through the beverage substrate and extracts and/or dissolves the substances required for the preparation of the beverage from the beverage substrate. For preparing an espresso, for example, a brewing water pressure of up to 20 bar acts on the coffee powder, in order for the ethereal oils to be extracted. However, the single serve capsules according to the prior art have the disadvantage that the produced beverage displays comparatively more foam on its surface.

It has thus been the object of the present invention to provide a single serve capsule which does not display the disadvantages of the prior art.

The object is achieved with a single serve capsule for producing a beverage, having a side wall and a base which collectively define a space, wherein within the space a filter element is sealed to the base and the sealing seam is provided so as to be toroidal, and wherein the outer diameter of the sealing seam is 75 to 85% of the diameter of the filter element.

The narrative referring to this subject matter of the present invention is equally applicable to the other subject matter of the present invention, and vice versa.

Surprisingly, it has now been found that a circular sealing seam, of which the outer diameter is 75 to 85% of the diameter of the filter element, leads to at least only very slight foam formation.

The filter element is provided so as to be disk-shaped and includes a circular cross section. The sealing seam which connects the filter element to the base of the single serve capsule in a materially integral manner is preferably applied by ultrasonic welding. After sealing, the filter element in the region of the sealing seam is preferably impermeable to fluids.

The inner diameter of the sealing seam is preferably 67 to 77% of the diameter of the filter element.

In one preferred embodiment, the width of the sealing seam is 1 to 1.5 millimeters.

The base of the single serve capsule preferably includes a substantially planar portion which is designed so as to be circular and the outer diameter of which is 84 to 94% of the diameter of the filter element. Preferably, a bead adjoins the outer diameter of the planar portion, by way of which bead the planar portion is somewhat spaced apart from a potential cantilevered position. Moreover, the bead forms the transition between the planar base and the side wall and imparts stability to the single serve capsule. The filter element preferably extends into the region of the bead and covers the latter at least in part, without being in contact therewith.

According to one preferred embodiment, the base includes a clearance which is so large that no substantial loss of pressure occurs when the beverage flows out/flows through this clearance. This clearance is preferably already incorporated into the capsule base before the filter element is sealed to the capsule base. The clearance, prior to the preparation operation, is preferably closed using a film or similar, which may be torn off or pierced by a piercing element.

The diameter of the filter element is preferably smaller, in particular 1 to 5% smaller, than the inner dimension of the single serve capsule at base level.

The filter element preferably includes a felt structure. In particular, here this is a needle felt structure. The filter element is preferably composed of at least one felt structure and one carrier structure, in particular a woven fabric structure, wherein particularly preferably the felt structure accounts for at least one part-portion of the volume of the carrier structure. The felt structure preferably extends across the entire cross section of the carrier structure, particularly preferably, however, only across a part-region of the height. The felt structure is preferably connected to the carrier structure in a form-fitting, force-fitting and/or materially integral manner. The filter element preferably includes two or more felt structures which are preferably separated from one another by the carrier structure. The thickness of the two felt structures may be identical or different. Preferably, a felt structure facing the powder or tea is thinner than the felt structure facing the capsule base, or vice versa. The surface of the felt structure is preferably treated, for example heat-treated, in order to fixate loose fibers for example. The filter element including a felt structure is preferably merely placed into the capsule, in particular onto the base thereof. However, the filter element may also be connected to the capsule, in particular the base thereof, particularly in a materially integral manner. During perforating, the perforating means may ingress into this filter element. Preferably, a plurality of filter elements which include one or a plurality of felt structures and a carrier structure are disposed in the capsule so as to be on top of one another and, optionally, connected to one another.

A filter element including a carrier structure, in particular a woven fabric structure, and a felt structure is manufactured, for example, in that a woven fabric structure composed of longitudinal and transverse threads is provided. For the construction of a felt, in particular a needle felt, fiber units of 0.8 to 7 dtex are preferably selected. The interconnection of the individual fibers in order to form a felt and/or the anchoring of said felt in the carrier structure preferably takes place by way of the production process of needling. Here, needles having reversed barbs pierce the presented fiber package at high speed and are withdrawn therefrom again. On account of the barbs, the fibers are mutually interlaced and/or interlaced with the carrier fabric by way of a plurality of loops being produced.

The carrier element including one or a plurality of felt structures preferably comprises a population per unit of mass (also referred to as grammage or area weight) between 100 and 800 grams per square meter, particularly preferably between 200 and 650 grams per square meter, and very particularly preferably substantially 150 to 250 grams per square meter for producing tea and 600 to 700 grams per square meter for producing coffee, espresso or similar. The filter element or the non-woven fabric, respectively, preferably has a thickness between 0.8 and 3.3 millimeters, particularly preferably between 1.1 and 3.0 millimeters, and very particularly preferably 1.2 to 1.4 millimeters for producing tea and 2.6 to 3.0 millimeters for producing coffee.

According to a further subject matter according to the invention or a preferred subject matter of the present invention, the side wall and the base are one injection-molded part.

The disclosure referring to this subject matter of the present invention is equally applicable to the other subject matter, and vice versa.

Preferably, the side wall and the base are provided so as to be integral.

An energy transducer is preferably provided on the base of the single serve capsule. This energy transducer may be toroidal, rectangular, square, oval, or may be of any other closed shape. The energy transducer may be continuous or be provided with interruptions. The energy transducer is preferably provided so as to be integral with the base and during injection molding is produced together with said base. The cross section of the energy transducer is preferably triangular, rectangular, square, toroidal, or oval. However, the cross section may have any other arbitrary shape, as long as the energy transducer protrudes from the surface. The energy transducer is preferably provided on the surface of the base which faces the space in which the beverage substrate to be extracted and/or dissolved is located.

Figure 2A:
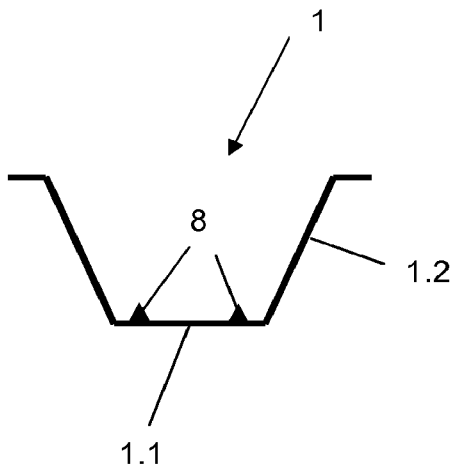

In the following, the invention is explained by means of FIGS. 1 and 2. These explanations are merely exemplary and do not limit the general concept of the invention. The explanations are equally applicable to all subject matter of the present invention. In the figures:

FIG. 1 shows a first embodiment of the single serve capsule according to the invention;

FIG. 2*a* shows a cross-sectional view of a further embodiment of the single serve capsule according to the invention.

Figure 2B:
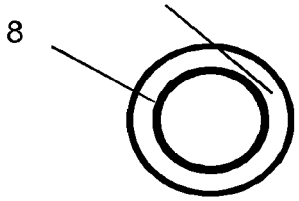

FIG. 2*b* shows a top view of the single serve capsule of FIG. 2*a*.

Figure 3:
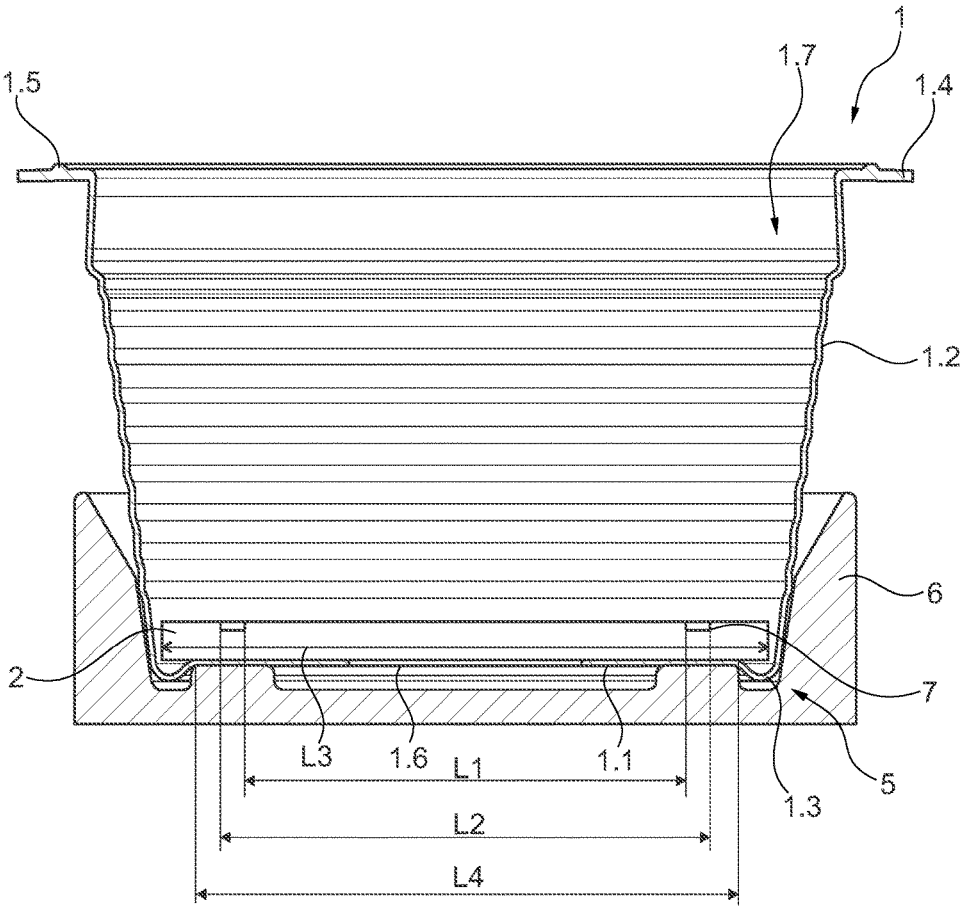

FIG. 3 shows the single serve capsule of FIG. 1 with the sealing tool removed.

FIG. 1 shows the single serve capsule 1 according to the invention, which in the present case is implemented so as to be of a substantially truncated-cone shape. The single serve capsule 1 includes an encircling side wall 1.2 and a base region 1.1. The side wall 1.2 and the base region 1.1 define a space 1.7 in which a filter element 2, which in the present case includes a felt structure, is located. The filter element 2 is sealed to the base 1.1 of the single serve capsule 1 by means of the tool 3 which, on its lower end, includes sealing faces 3.1, while configuring a sealing seam 7. Here, the single serve capsule 1 is held at least in part in a counter element 6. The base 1.1 of the single serve capsule includes a circular planar portion which, on its outer end, is adjoined by a toroidal bead 1.3 which simultaneously represents the transitional region 5 between the base and the side wall. The planar portion of the base is spaced apart by the bead 1.3 from a potential support on which the bead rests. A clearance 1.6, here being a circular clearance, which is preferably so large that no noteworthy loss of pressure occurs and/or that the produced beverage is not swirled when the produced beverage flows out of the single serve capsule, is provided in the planar portion. As soon as the filter element 2 has been sealed to the base of the single serve capsule, in particularly sealed thereto by ultrasound, and the tool 3 has been removed from the single serve capsule, the latter is filled with a beverage substrate, for example coffee grounds, and then closed, preferably using a film which is sealed or adhesively bonded to the flange 1.4 which adjoins the side wall in an toroidal manner. To this end, the flange preferably includes a bulge 1.5 which serves as a defined sealing face.

According to the invention, it is now provided that the welding seam is provided so as to be toroidal and that the outer diameter of the sealing seam L2 is 75 to 85%, in this case 76.6%, of the diameter L3 of the filter element. On account of this arrangement of the sealing seam, no noteworthy foam is produced in the production of the beverage, in particular in the production of coffee. The inner diameter L1 of the sealing seam is preferably 67 to 77%, in this case 72.5%, of the diameter of the filter element. The width of the sealing seam is preferably 1.5 millimeters. During welding the filter element 2 is connected to the capsule base 1.1, on the one hand. However, the felt structure is also simultaneously compressed at least in part and preferably fixated when compressed. In the region of the welding seam transverse flows in the felt structure are preferably at least restricted. Furthermore, the outer diameter of the filter element is preferably provided so as to be larger than the outer diameter of the planar portion of the filter base. The outer diameter L4 of the planar portion of the capsule base is preferably 84 to 94%, in this case 90%, of the diameter L3 of the filter element. The filter element 2 consequently protrudes into the region of the bead, without contacting the bottom of the bead. Furthermore, the outer diameter L3 of the filter element is preferably smaller than the diameter of the single serve capsule in the region of the base. The sealing seam is preferably provided so as to be concentric with the clearance 1.6 in the capsule base.

In the embodiment according to FIG. 2, the base 1.1 and the side wall 1.2 are preferably made as one injection-molded part, preferably from plastic. Furthermore, the base includes an energy transducer 8 which, in the present case, is provided as a toroidal elevation, here having a triangular cross section. It will be understood by a person skilled in the art that the energy transducer may also have another cross section and also need not be provided so as to be continuous. Using the energy transducer, a line-shaped sealing seam between the filter element and the base of the capsule is attainable. The energy transducer is provided on the surface of the base 1.1 which faces the space 1.7. In the lower illustration, the side wall 1.2 has been omitted for the sake of clarity.

LIST OF REFERENCE SIGNS:

1 Single serve capsule
1.1 Base region
1.2 Side wall
1.3 Transition from base region to side wall, bead
1.4 Flange

1.5 Bulge in the flange, sealing face
1.6 Clearance
1.7 Space
2 Filter element, felt
3 Sealing tool
3.1 Sealing face
4 -
5 Transitional region between base 1.1 and side wall 1.2
6 Counter element
7 Sealing seam
8 Energy transducer
L1 Inner diameter of the sealing seam, e.g. 22.5 mm
L2 Outer diameter of the sealing seam, e.g. 25.0 mm
L3 Diameter of the filter element, e.g. 31.0 mm
L4 Diameter of planar part of the base, e.g. 28.0 mm

The invention claimed is:

1. A single serve capsule for producing a beverage, having a side wall and a base which collectively define a space, wherein within the space a filter element is sealed to the base to form a sealing seam, characterized in that the sealing seam is continuous and is provided so as to be toroidal and in that the outer diameter (L1) of the sealing seam is 75 to 85 percent of the diameter (L3) of the filter element.

2. The single serve capsule as claimed in claim 1, characterized in that the width of the sealing seam is 1 to 1.5 millimeters.

3. The single serve capsule as claimed in claim 1, characterized in that the base includes a substantially planar portion, the outer diameter (L4) of the planar portion is 84 to 94 percent of the diameter (L3) of the filter element.

4. The single serve capsule as claimed in claim 1, characterized in that the base includes an opening that prevents substantial loss of pressure when the beverage flows out through the opening.

5. The single serve capsule as claimed in claim 1, characterized in that the diameter (L3) of the filter element is 1 to 5 percent smaller than an inner dimension of the single serve capsule at base level.

6. The single serve capsule as claimed in claim 1, characterized in that the filter element at least in portions includes a felt structure.

7. The single serve capsule as claimed in claim 6, characterized in that the filter element is provided so as to be multi-layered.

8. The single serve capsule as claimed in claim 1, characterized in that the side wall and the base are one injection-molded part.

9. The single serve capsule as claimed in claim 8, characterized in that an energy transducer is provided on the base.

10. The single serve capsule as claimed in claim 9, characterized in that the energy transducer is located on a surface of the base which faces the interior.

* * * * *